US007356976B2

(12) United States Patent
Tosa

(10) Patent No.: US 7,356,976 B2
(45) Date of Patent: Apr. 15, 2008

(54) METHOD AND AN APPARATUS FOR AUTOMATIC CHANGE OF THE REEL OF EXTENSIBLE FILM IN WRAPPING MACHINES FOR THE PACKAGING OF PALLETIZED LOADS

(75) Inventor: Giuseppe Tosa, Cossano Belbo (IT)

(73) Assignee: Tosa S.r.l., Cuneo (IT)

( * ) Notice: Subject to any disclaimer, the term of this patent is extended or adjusted under 35 U.S.C. 154(b) by 0 days.

(21) Appl. No.: 11/069,671

(22) Filed: Mar. 1, 2005

(65) Prior Publication Data

US 2005/0193687 A1 Sep. 8, 2005

(30) Foreign Application Priority Data

Mar. 22, 2005 (IT) ..... TO2004A0129

(51) Int. Cl.
*B65B 11/00* (2006.01)

(52) U.S. Cl. ..... 53/399; 53/389.1; 242/559.4

(58) Field of Classification Search ..... 53/399, 53/389.1, 587, 588, 167, 118, 211; 242/559.1, 242/559.2, 559.3, 559.4
See application file for complete search history.

(56) References Cited

U.S. PATENT DOCUMENTS 4,723,884 A * 2/1988 Brinker et al. ..... 414/796.9
4,914,891 A * 4/1990 Suolahti ..... 53/399
5,169,271 A * 12/1992 Yamashita ..... 414/27
5,226,778 A * 7/1993 Sekitani ..... 414/744.3
5,562,385 A 10/1996 Tacchi et al.
6,494,400 B1 * 12/2002 Zitella et al. ..... 242/559.3
6,553,746 B1 * 4/2003 Cere' ..... 53/589
6,772,573 B2 * 8/2004 Federeszyn ..... 53/389.2
2003/0066269 A1 4/2003 Federeszyn

FOREIGN PATENT DOCUMENTS

EP 0 293 352 11/1988
EP 1 097 867 A1 5/2001
EP 1 201 584 A2 5/2002
EP 1 273 516 A1 1/2003
EP 1 502 856 A1 2/2005

* cited by examiner

*Primary Examiner*—Thanh K. Truong
(74) *Attorney, Agent, or Firm*—Merchant & Gould P.C.

(57) ABSTRACT

A film changer apparatus changes the reel of extensible film in wrapping machines for packaging palletized loads. A supporting structure has an assembly for carrying the reel of the wrapping film and retains the free end of the film of a reel. Supporting structure is vertically movable between a wrapping position and a lowered position for changing a reel. A retainer provides temporary support of the free end of the film and is movable between two end positions. The automatic changer includes a release and expulsion device for the reel and for positioning the carriage for placing the reel into proper position. The changer also includes devices to position the spindles for carrying the reels to pick up the new reel from the carriage and transfer the free end of the film to be retained. The changer moves the support structure back to a wrapping position and moves the carriage to bring a new reel from the reel changer.

11 Claims, 15 Drawing Sheets

FIG. 1
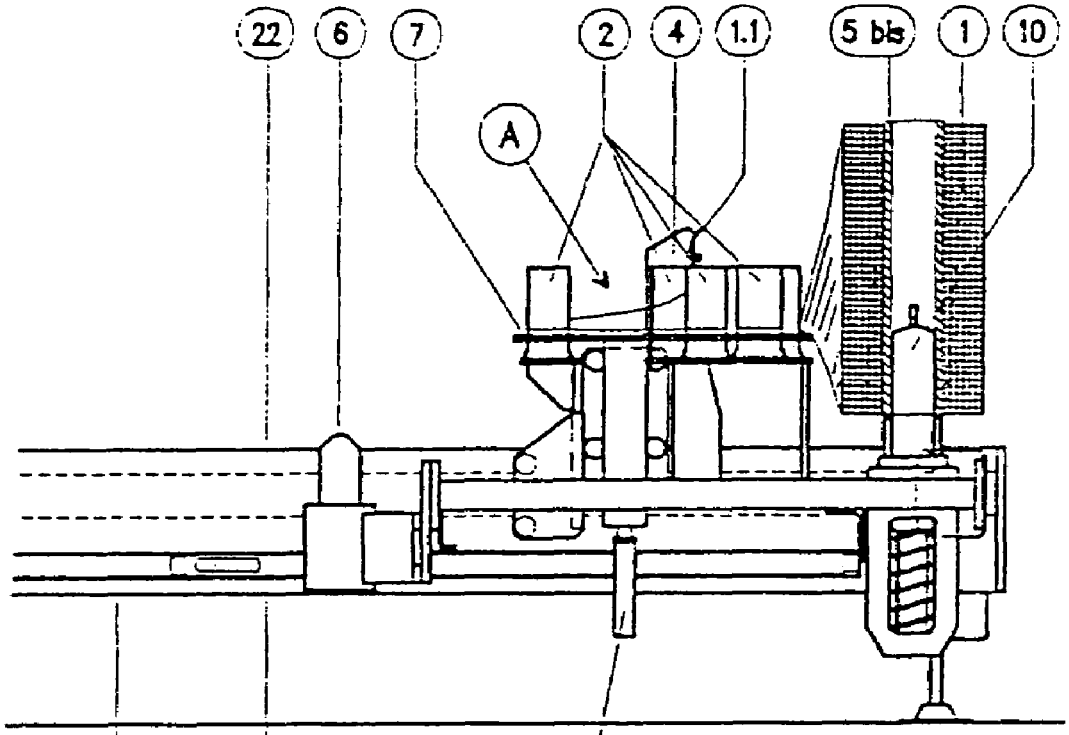
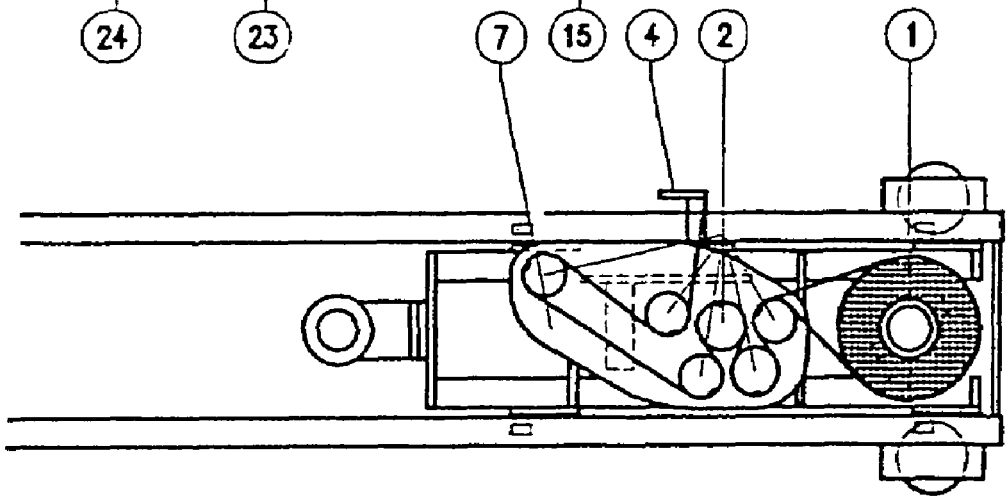
FIG. 1a

METHOD AND AN APPARATUS FOR AUTOMATIC CHANGE OF THE REEL OF EXTENSIBLE FILM IN WRAPPING MACHINES FOR THE PACKAGING OF PALLETIZED LOADS

The subject of the invention is a method and an apparatus for automatic change of the reel of extensible film in wrapping machines for the packaging of palletized loads.

In wrapping machines for the packaging of palletized loads, when the reel of film runs out or presents defects it must be replaced.

An operation of this kind, if carried out manually by an operator, can take up quite a lot of time, during which the machine remains stationary and inoperative, with consequent lengthening in the corresponding production cycle.

The main purpose of the invention is to propose an apparatus for automatic change of the reel that has run out or presents defects; in this way the dead times due to reel change can certainly be limited to the minimum indispensable, and the use of an operator is not required throughout the step of reel change but only for the operations of loading of the reels on the service carriage, which can be carried out at any moment, without the automatic cycle being interrupted.

For these and other purposes that will emerge more clearly from what follows, the invention proposes providing an apparatus and a method for automatic change of the reel of extensible film in wrapping machines for the packaging of palletized loads.

The method and the equipment according to the invention will now be described with reference to the attached plate of drawings, in which:

FIG. 1 and FIG. 1*a* illustrate a detail of the apparatus according to the invention in a front view and a plan view, respectively;

Figure 11:
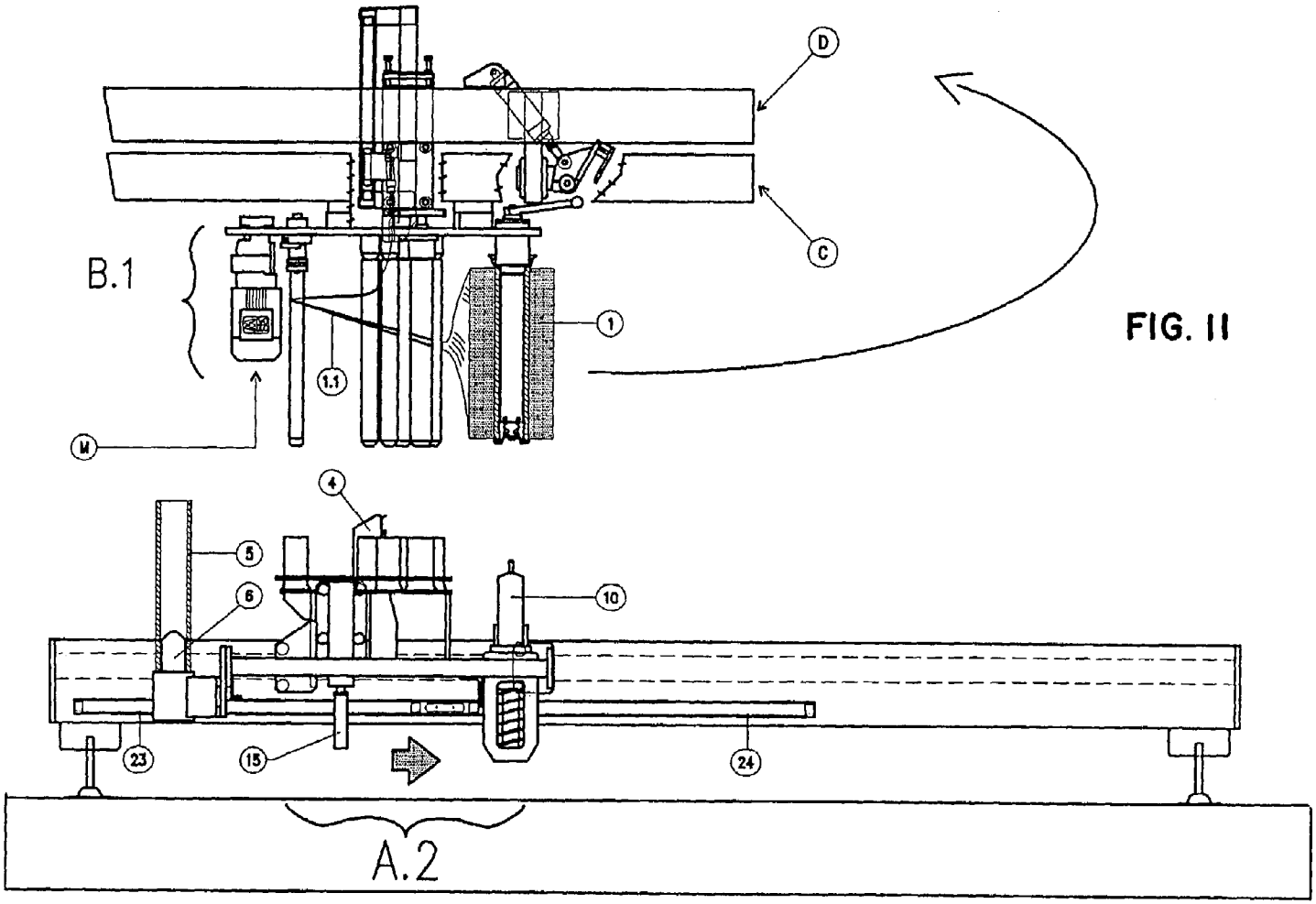

When, in an automatic wrapping machine during the operation of wrapping of the pallet P (FIG. 12), the reel of film 1 (FIG. 11) runs out or presents defects, it must be replaced.

To carry out automatic reel change a service carriage A is necessary, which will bring the reel 1 into a position for being replaced.

Figure 6:
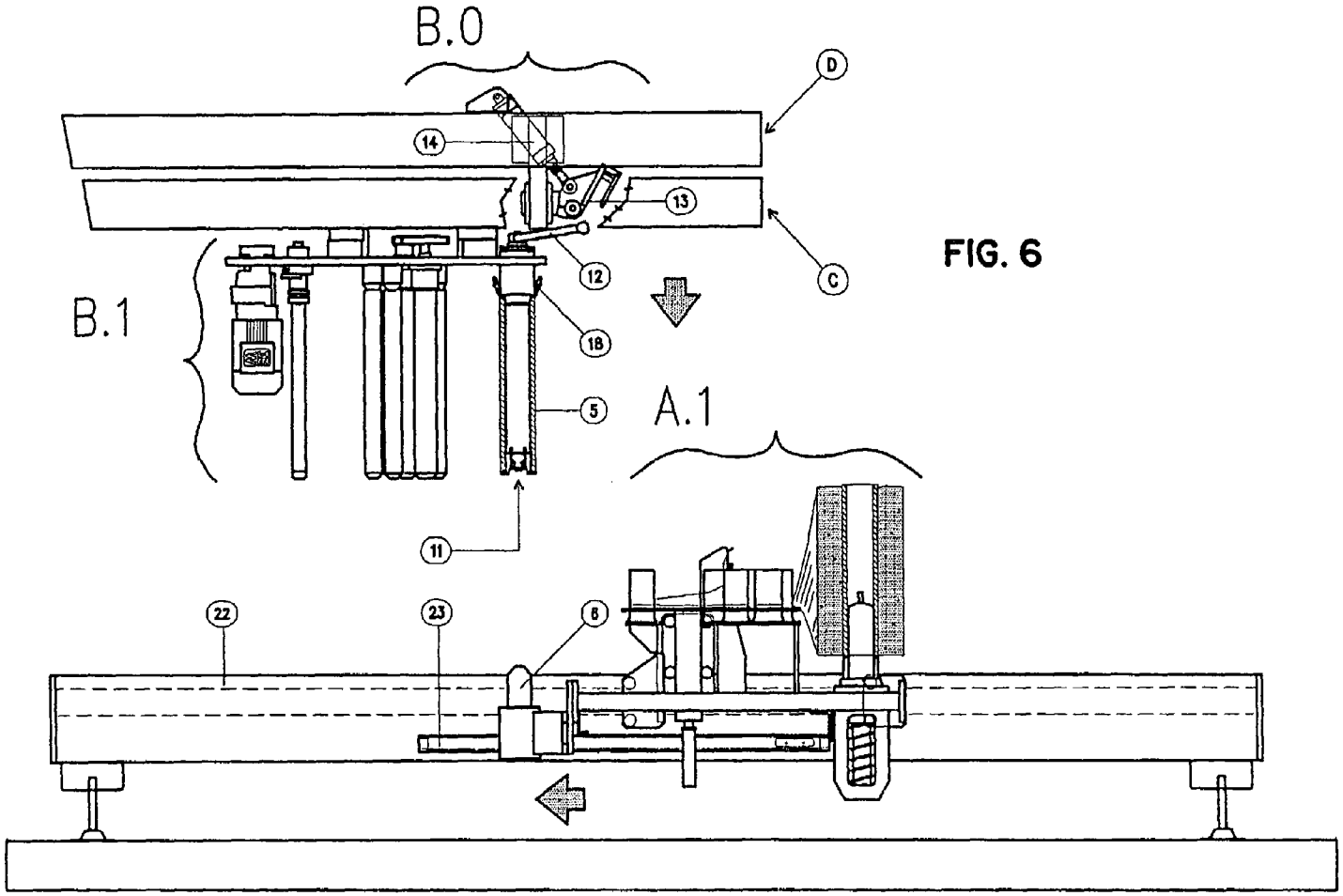

On the service carriage A (FIG. 1), which can slide on linear guides, there is fixed a set of sleeves each having a longitudinal groove 2, the telescopic spindle 10 for housing the new reel 1, the fixed spindle 6 for unloading the reel that has run out or is defective 5 (FIGS. 6-7), the spring clamp 4 for fixing the trailing end of the film 1.1, and the film-pusher plate 7, which can slide on linear guides and is provided with holes each having a projecting tab, inserted in the set of grooved sleeves 2.

Figure 3:
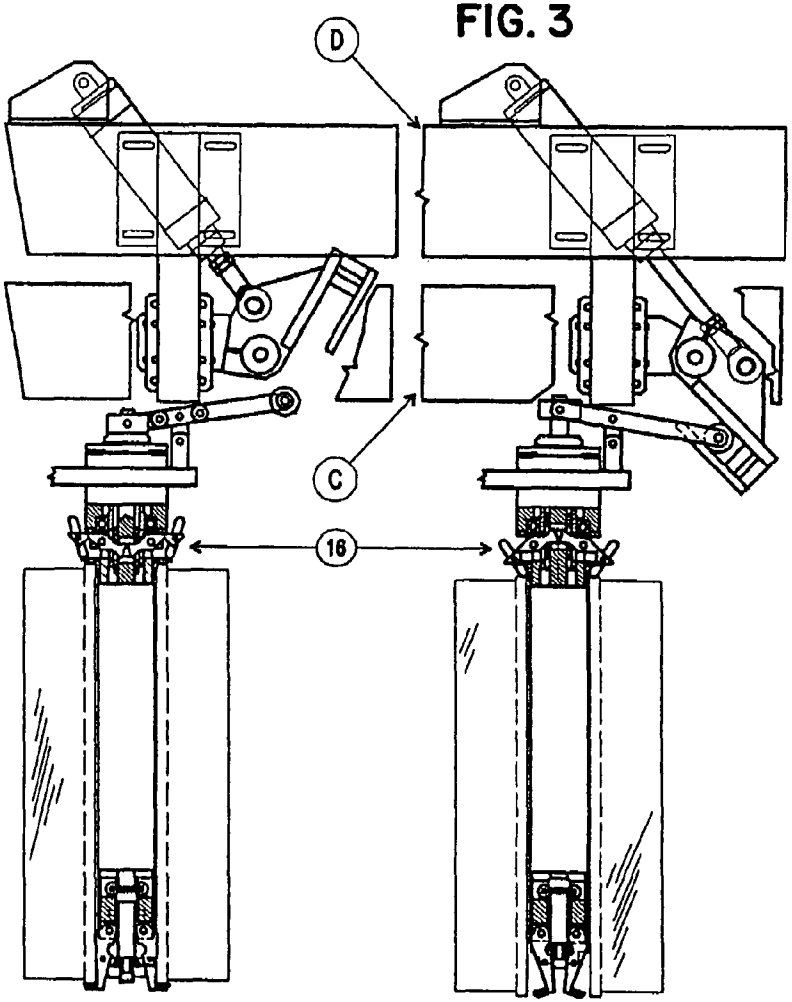
FIG. 3 illustrates an enlarged detail of FIG. 2 in two different operating steps.
Figure 2:
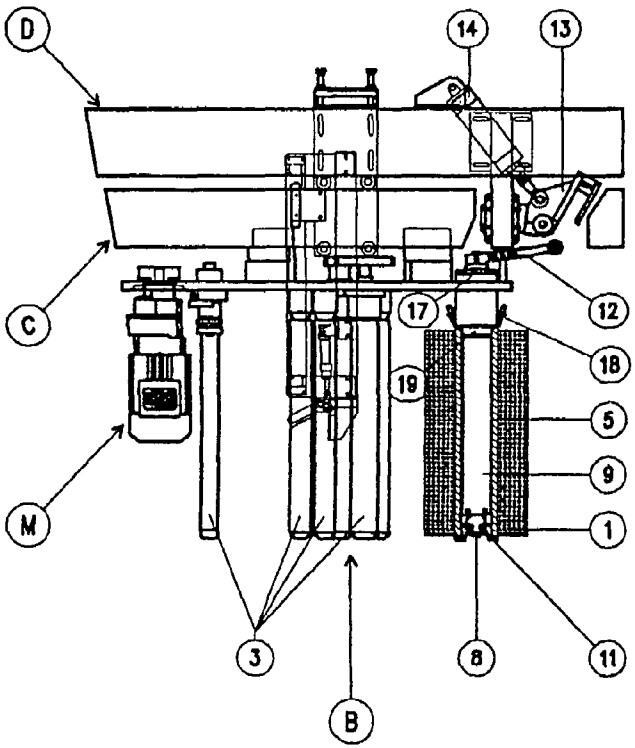
FIG. 2 illustrates a second detail of the apparatus according to the invention in a front view.
Figure 5:
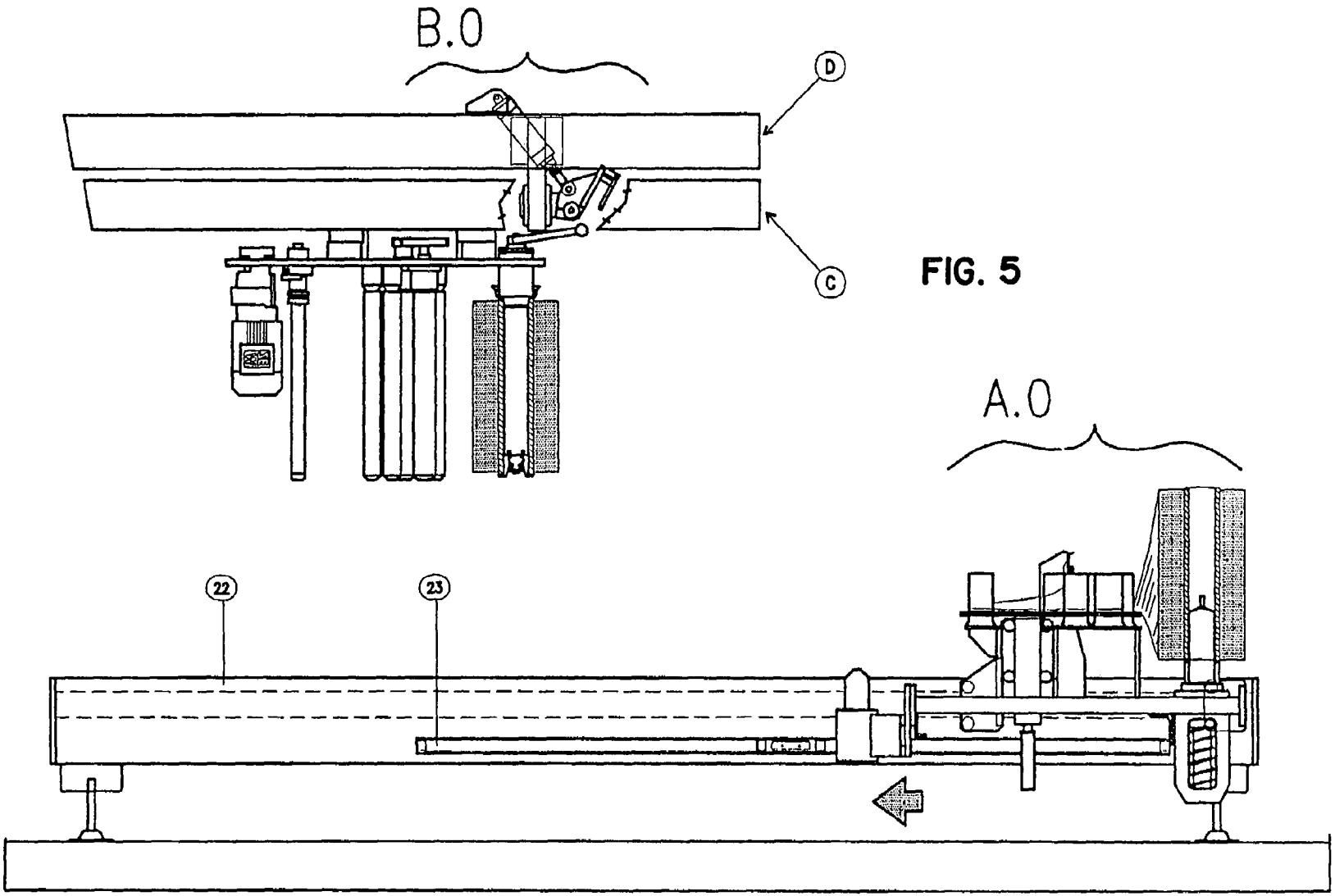
FIGS. 5-12 illustrate the apparatus according to the invention in all the various operating steps.

On the service carriage A, in the parking position A.0 (FIG. 5), the operator has previously inserted the new reel 1 in the telescopic spindle 10, unwinding approximately two meters of film and inserting it between the set of sleeves 2, each provided with a vertical groove and arranged exactly in a position corresponding to the set of rollers 3 (FIG. 2) of the reel-carrier assembly B fixed to the rotating ring C of the wrapping machine, said rotating ring being supported by the frame D. The trailing end of the film 1.1 is restrained in the spring clamp 4.

When the signal indicating that the film has run out or is defective is issued, the fixed or rotating supporting structure C of the wrapping machine comes to a halt in the position of reel change B.0 (FIG. 5), whilst the sliding frame D stops the reel-carrier assembly B at the pre-set height B.1 (FIG. 6) to enable transit of the service carriage A.

Figure 7:
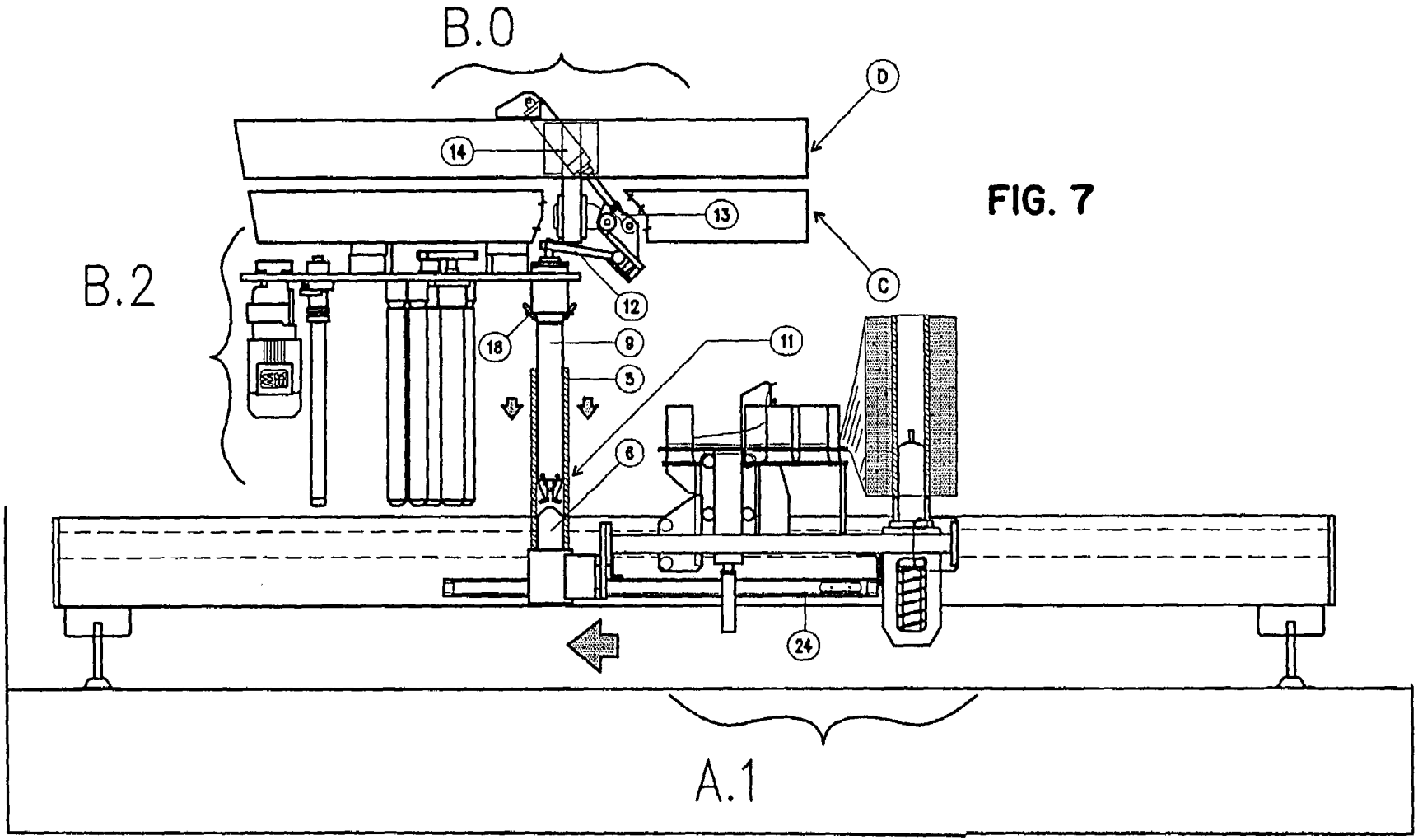

At the same time, the service carriage A starts, being actuated, for example, by a pneumatic cylinder 23 or other system, and comes to a halt in a position of expulsion of the reel that has run out or is defective A.1 (FIG. 7).

The sliding frame D drops down into a position for expulsion of the reel that has run out or is defective B.2 (FIG. 7).

The core of the reel that has run out or is defective 5 is released and expelled, being inserted in the spindle 6 provided, which is in perfect alignment with the pick-up spindle 9.

Figure 4:
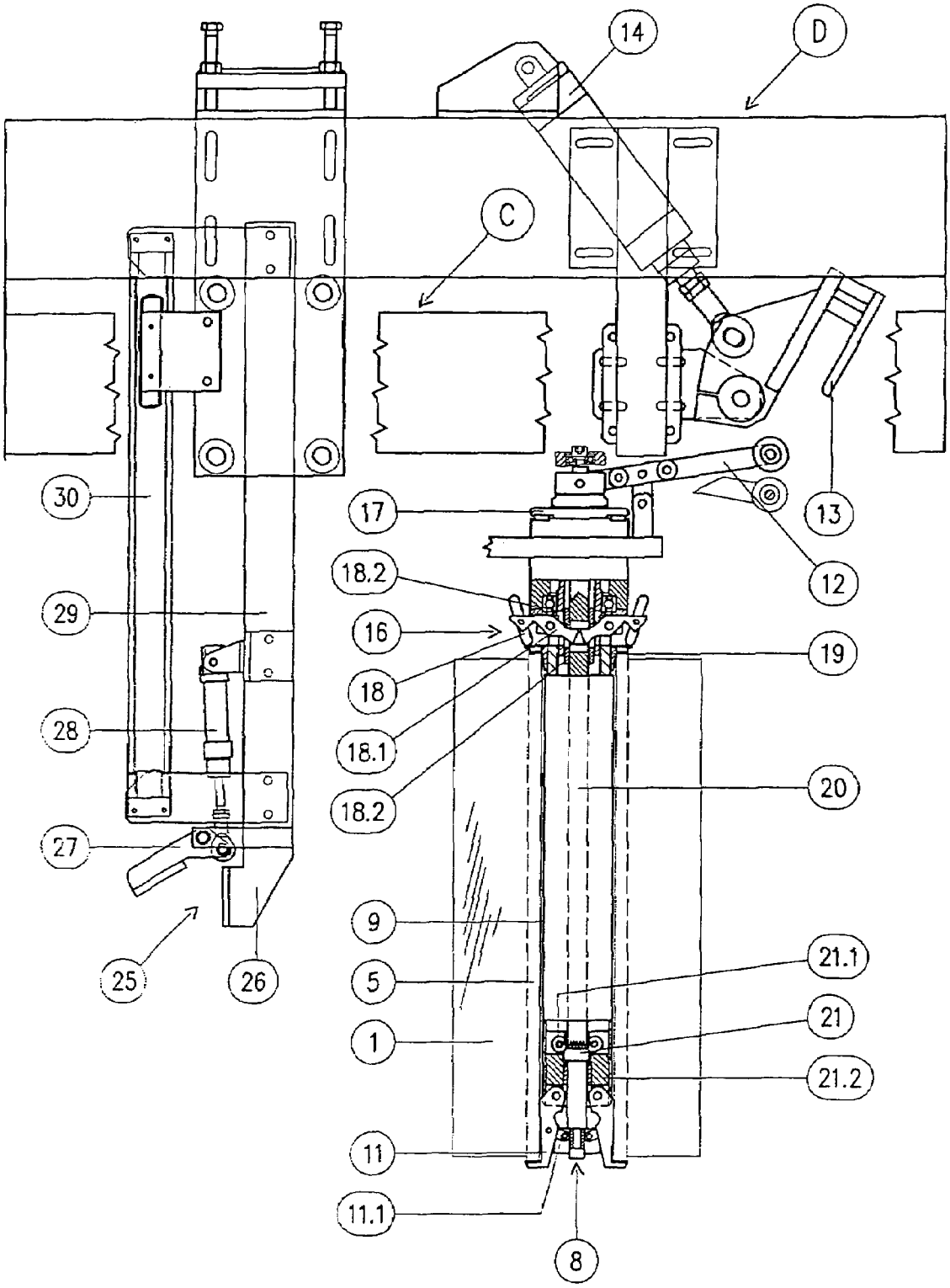
FIG. 4 illustrates a number of details of FIG. 2 further enlarged.

Release of the core of the reel that has run out or is defective 5 occurs with closing of the jaws with supporting lug 11 (FIG. 4) of the engagement assembly 8, which are actuated by the puller/pusher 20 by means of the lever 12 positioned by the cam 13, which is controlled, for example, by a pneumatic cylinder 14 or other system, which is fixed to the sliding frame D. Should the reel that has run out or is defective 5, which normally falls by gravity, remain jammed in the centering cone 19, it would be expelled by the pushers 18, which are hinged on levers 18.1 and are actuated by collars 18.2 fixed on the puller 20, which is held in position by a ring 21, which is in turn anchored to the puller 20 and is blocked by the rollers 21.1 that are fixed to the anchoring hub 21.2 of the pick-up spindle 9 (said positions referring to FIG. 4).

After release of the reel that has run out or is defective 5, the sliding frame D of the fixed or rotating supporting structure C is raised, positioning the assembly for carrying a reel B at the height of start of rotation B.1 (FIG. 11) to enable translation of the service carriage A.

The rotation mentioned above refers to the reel-carrier assembly for automatic wrapping machines with the pallet stationary, or else to the turning platform in the case of the pallet rotating.

The position of expulsion can be eliminated by unloading the reel that has run out or is defective 5 directly into a collection box prior to parking of the service carriage A in the position of picking-up of a new reel A.2.

Figure 8:
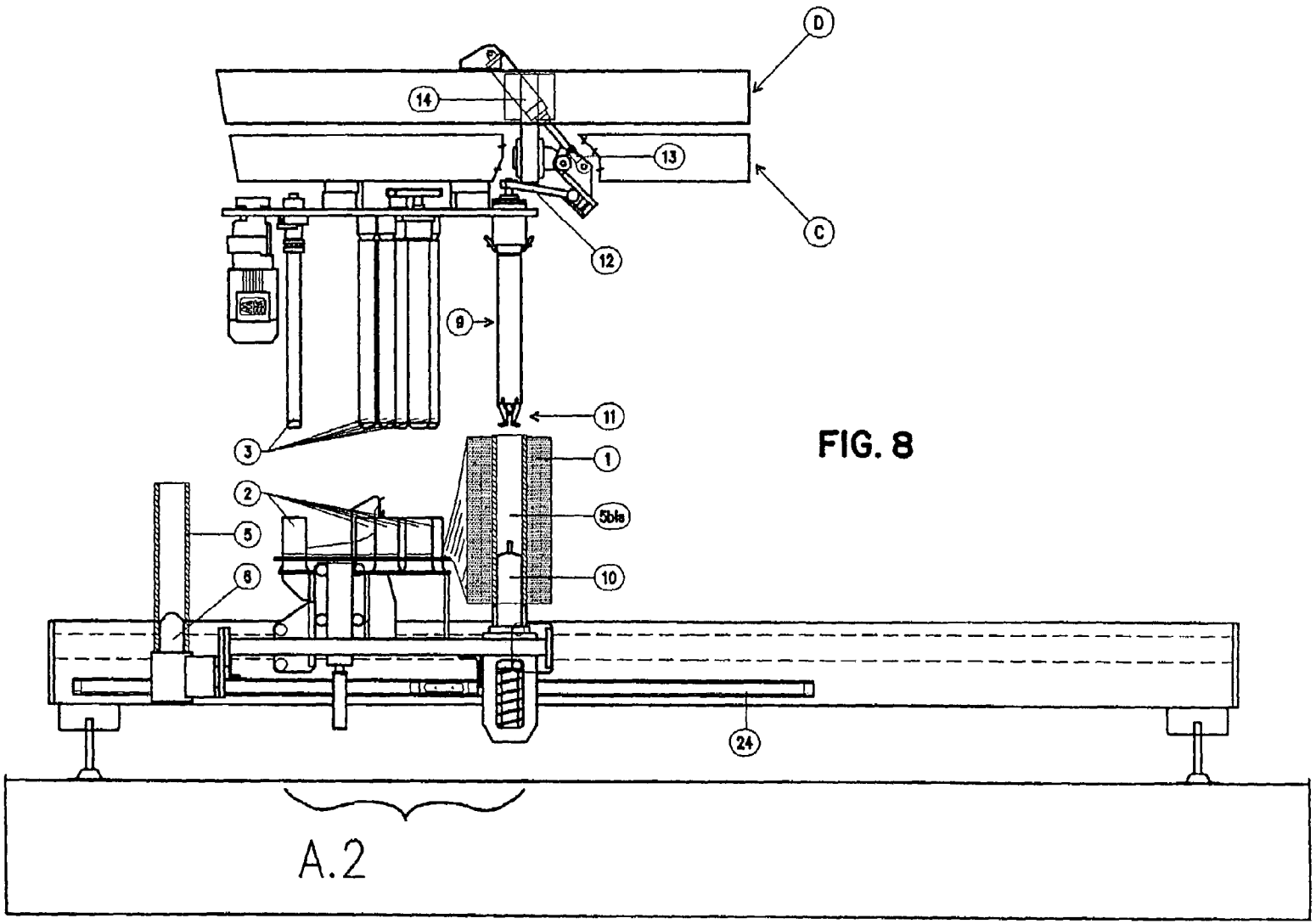

The service carriage A shifts into a position for picking up the new reel A.2 (FIG. 8), being actuated, for example, by a cylinder 24 or other system, whilst the fixed or rotating supporting structure C remains stationary together with the reel-carrier assembly B.

Figure 9:
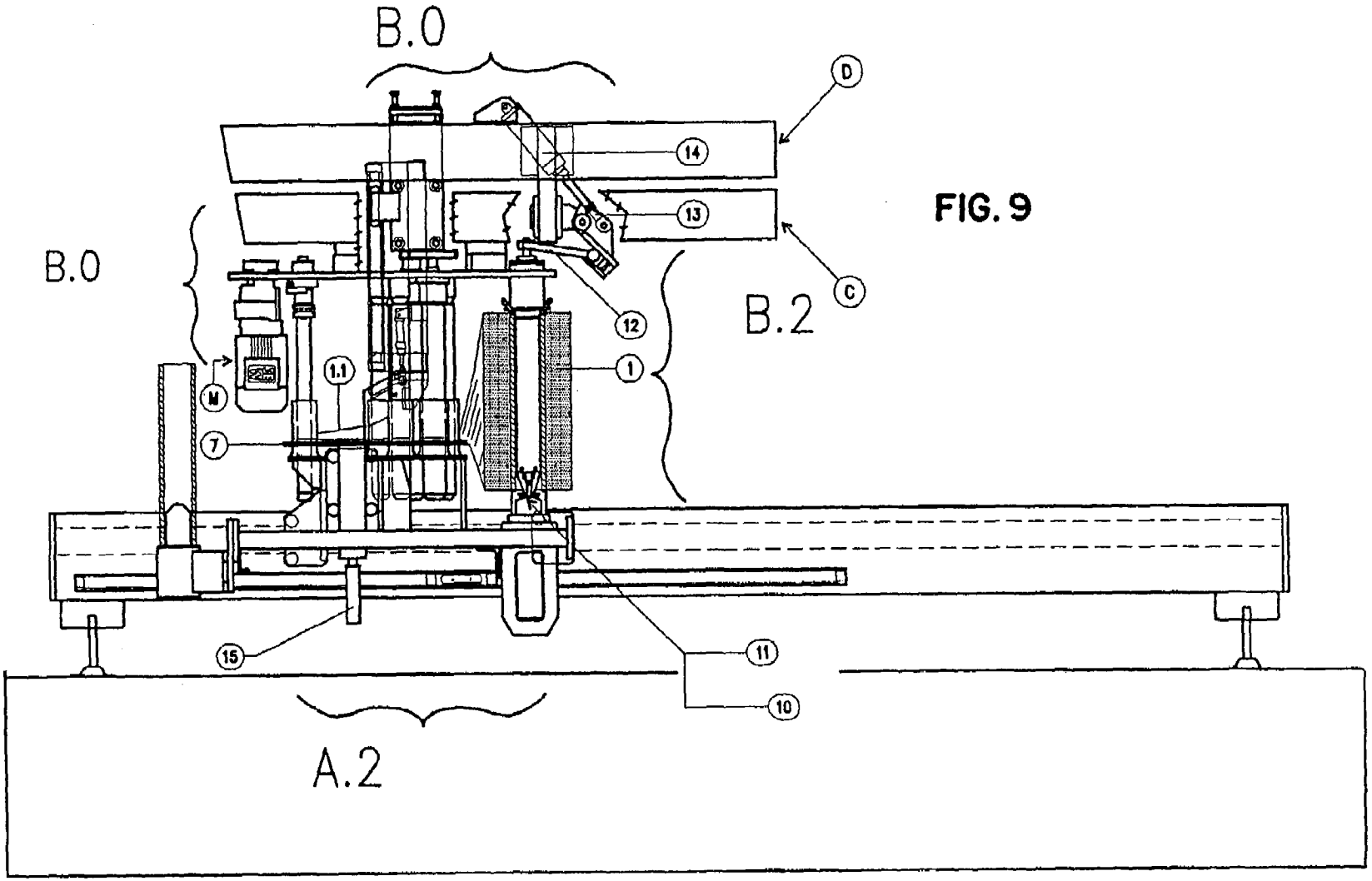

The sliding frame D drops, lowering the reel-carrier assembly B to the picking-up height B.2 (FIG. 9). The roller assembly 3 is inserted in the assembly of grooved sleeves 2, and the pick-up spindle 9 slides into the core 5*bis* of the new reel 1, pushing the telescopic spindle 10 fixed on the service carriage A downwards.

Figure 10:
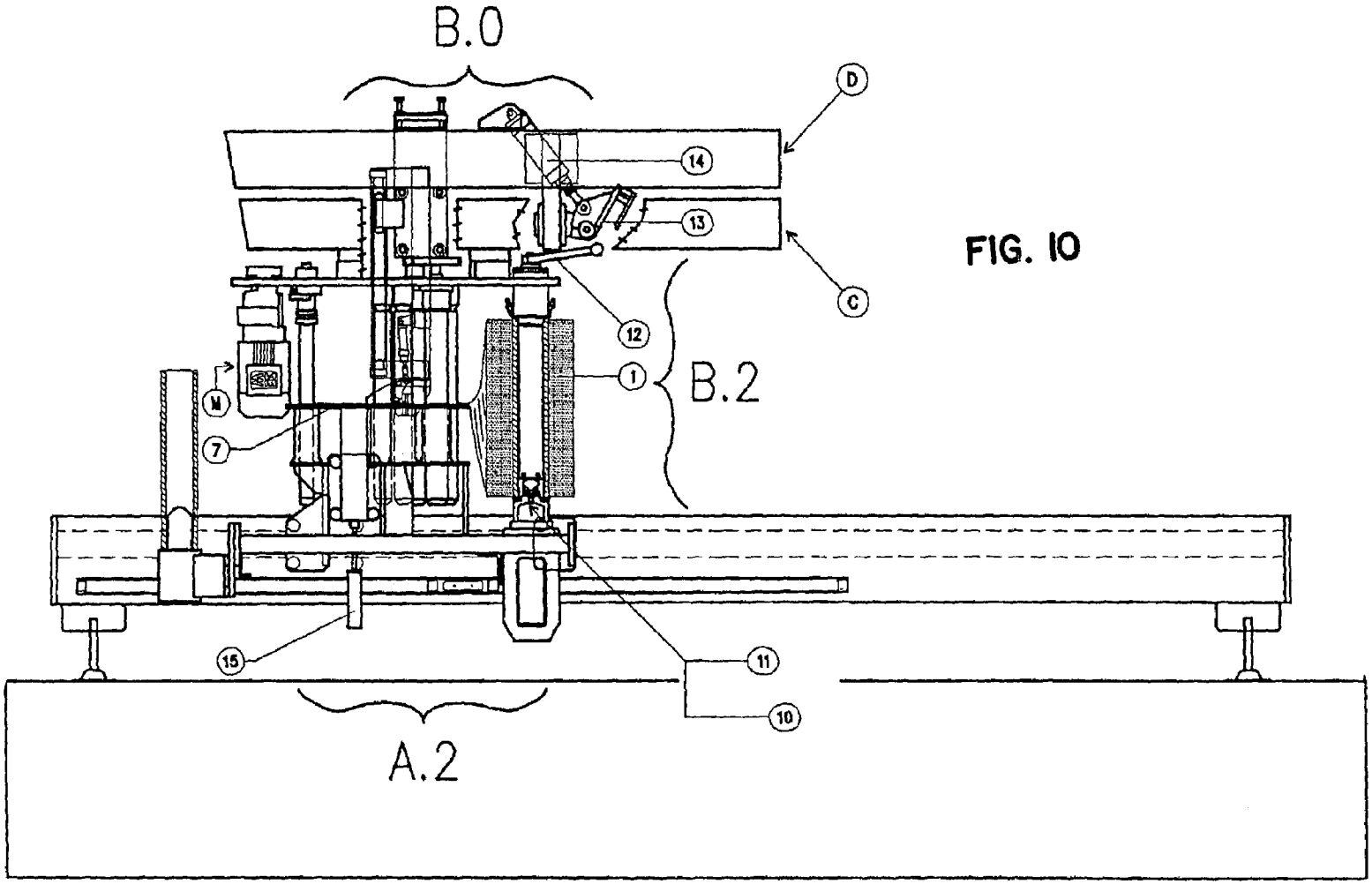

The perforated plate 7, provided with projecting tabs that insert into the grooves of the sleeves 2, is raised, being actuated, for example, by a pneumatic cylinder 15 or other system, so pushing the film beyond the set of sleeves 2. The film thus remains inserted between the set of rollers 3 of the reel-carrier assembly B (FIG. 10).

The gripper 25 (see FIGS. 4-9) drops. Said gripper is formed by a fixed jaw 26 and a mobile jaw 27, the latter being actuated, for example, by a pneumatic cylinder 28 or other system. Descent of the gripper 25 occurs by means of a linear guide 29, and is actuated, for example, by a pneumatic cylinder 30 or other system, which positions the gripper 25 in the gripping position B.0*bis* (FIG. 9) of the trailing end of the film 1.1, fixed in the spring clamp 4 set on the service carriage A.

At the same time as the plate 7 is raised, there are carried out a series of manoeuvres, as described in what follows.

The engagement device 8 (FIGS. 4 to 10) of the pick-up spindle 9 is actuated so that it opens the jaws with lugs 11 with the aid of shackles 11.1, which are controlled by the puller/pusher 20 by means of the lever 12, positioned by the cam 13, which is controlled, for example, by a pneumatic cylinder 14 or other system.

The mobile jaw 27 of the gripper 25 closes, being actuated, for example, by a pneumatic cylinder 28 or other system, so blocking the trailing end of the film 1.1, which is fixed in the spring clamp 4 set on the service carriage A.

The pick-up spindle 9 is moreover provided with an anti-wrapping brake with adjustable torque 17 and a top centring cone with compensation springs 19 so as to adapt to possible minor variations in length of the core 5*bis* of the new reel 1.

The gripper 25 goes back up by means of the linear guide 29, being actuated, for example, by a pneumatic cylinder 30 or by some other system, and moves into the "WRAPPING" position B.1*bis* (FIG. 12), sliding the trailing end of the film 1.1 out of the spring clamp 4 set on the service carriage A.

After raising of the plate 7, set on the service carriage A, and of the gripper 25, fixed to the frame D, the reverse rotation of the motor M (FIGS. 10 and 11) of the pre-stretching assembly set on the reel-carrier assembly B is actuated to obtain an optimal tensioning of the trailing end of the film 1.1 about the set of rollers 3 of the reel-carrier assembly B. The reverse rotation is necessary since, during transfer of the trailing end of the film 1.1 from the set of sleeves 2 set on the service carriage A to the set of rollers 3 set on the reel-carrier assembly B, obtained by raising the plate 7 set on the service carriage A, there is a slackening of the trailing end of the film 1.1 due to the difference in the diameters (larger sleeves 2–smaller rollers 3), which could cause the trailing end of the film 1.1 to slide out of the set of rollers 3, during subsequent raising of the reel-carrier assembly B.

The sliding frame D of the fixed or rotating supporting structure C is raised, positioning the reel-carrier assembly B at the height of start of rotation B.1 (FIG. 11) of the reel-carrier assembly or else of the pallet.

The service carriage A, actuated, for example, by the cylinders 23 and 24 or by some other system, returns to the parking position A.0.

Figure 12:
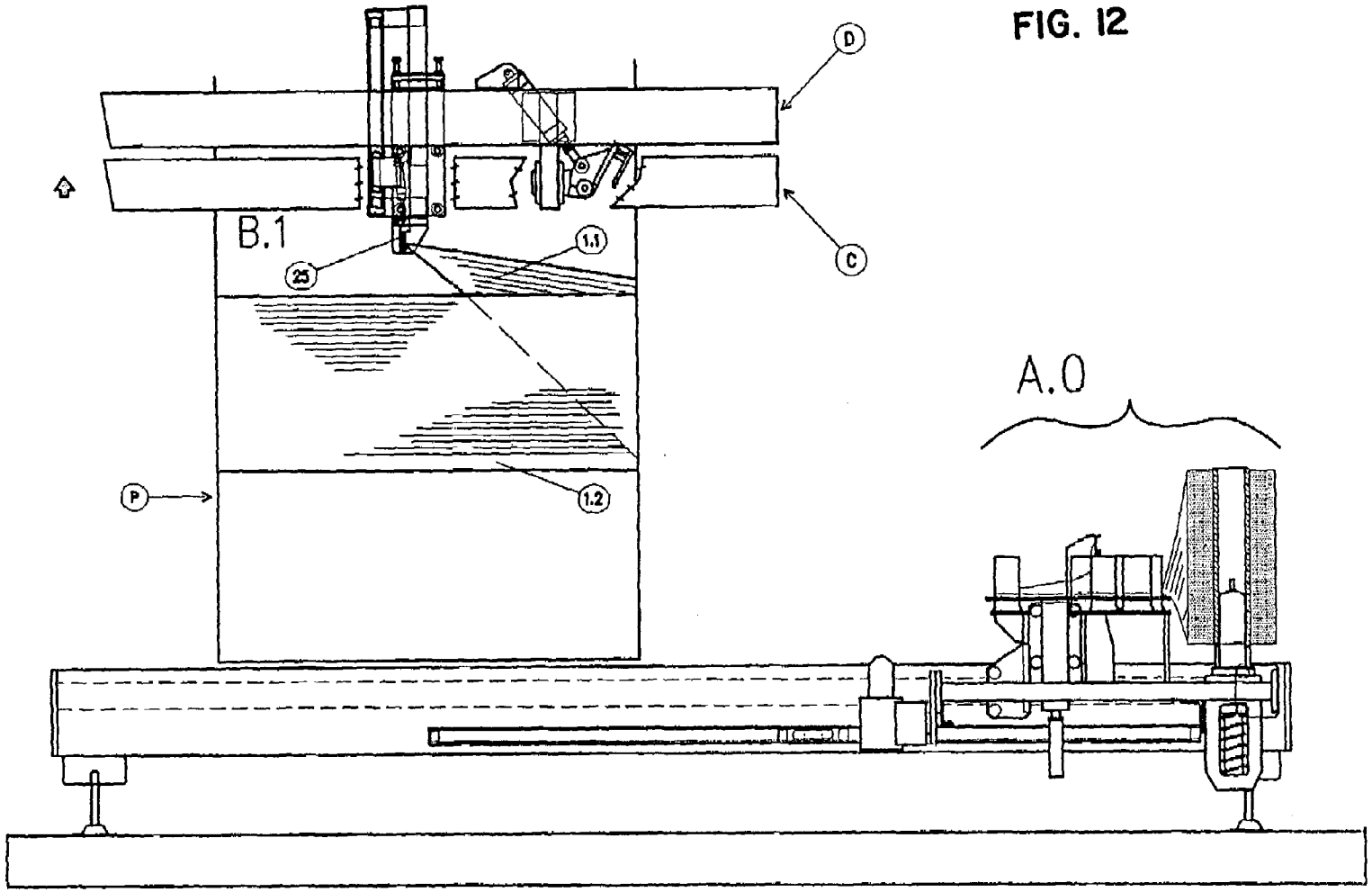

In the case of the pallet being stationary, the fixed or rotating supporting structure C is set in motion with the sliding frame D stationary, drawing along the reel-carrier assembly B, which rotates about the pallet P (FIG. 12). In the case of the pallet rotating, the fixed or rotating supporting structure C and the sliding frame D remain stationary while the pallet starts its rotation. After performing a rotation of approximately 1.5 turns (450°), the film with the web completely distended 1.2 overlaps the trailing end 1.1 fixed in the gripper 25.

The gripper 25 opens the mobile jaw 27, abandoning the trailing end 1.1, which is folded on the wind that has just been made, while the wrapping cycle is completed.

The service carriages A may also number more than one.

Figure 13:
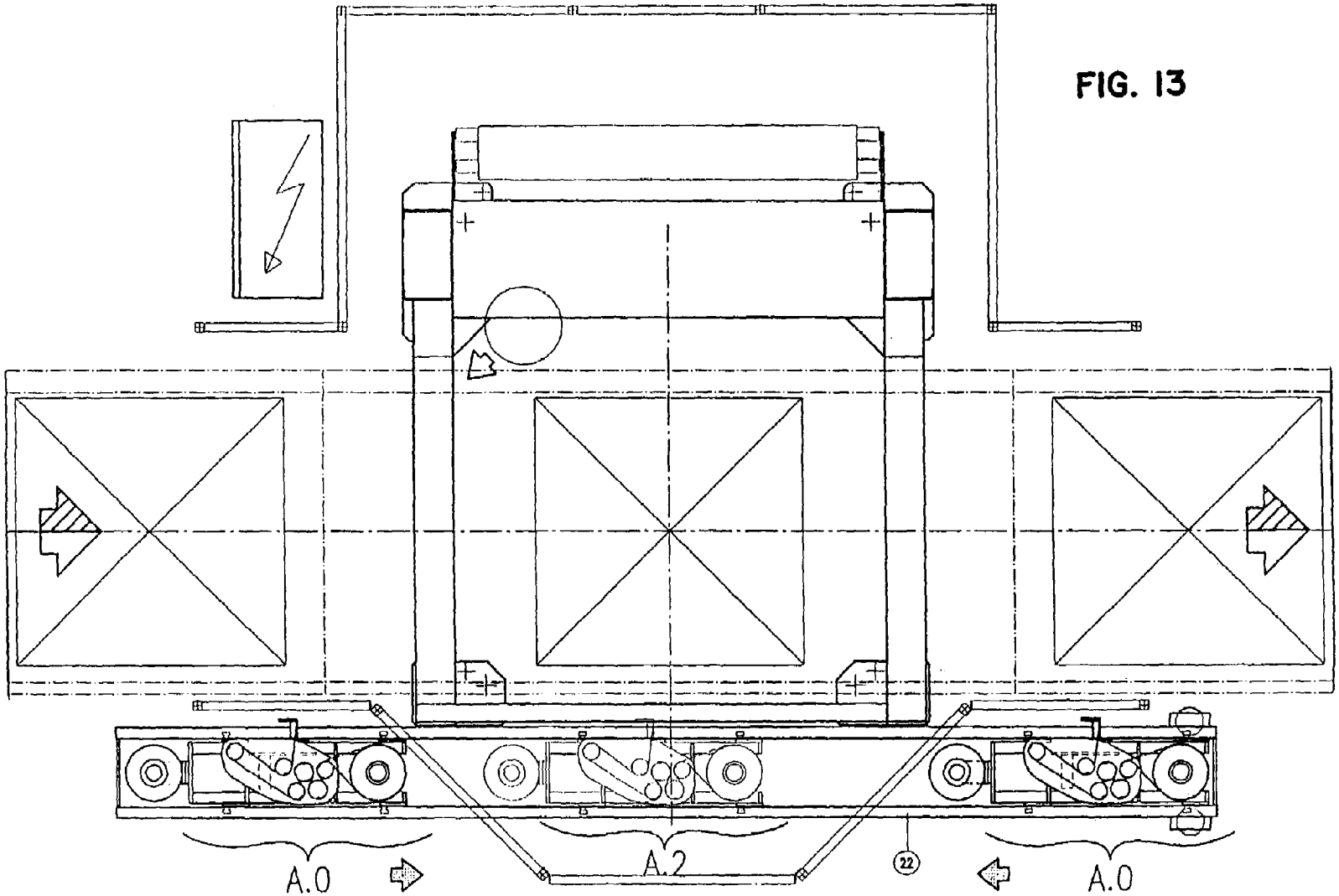
FIG. 13 is the schematic plan view of a first operating mode of the apparatus defined as linear mode.
Figure 14:
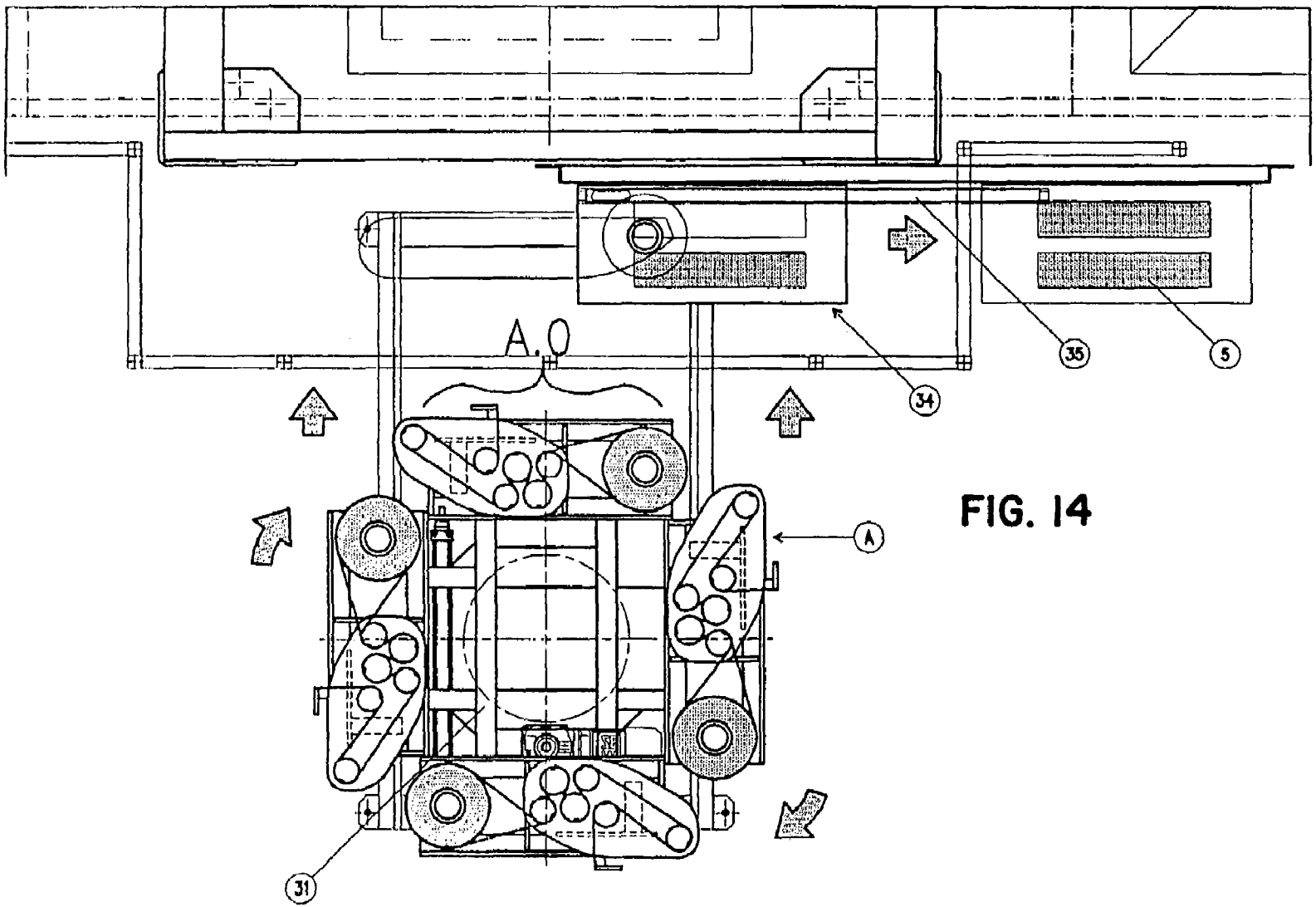
FIGS. 14 and 15 are plan views in two different operating steps of a detail of the apparatus provided in a second operating mode defined as carousel mode.
Figure 15:
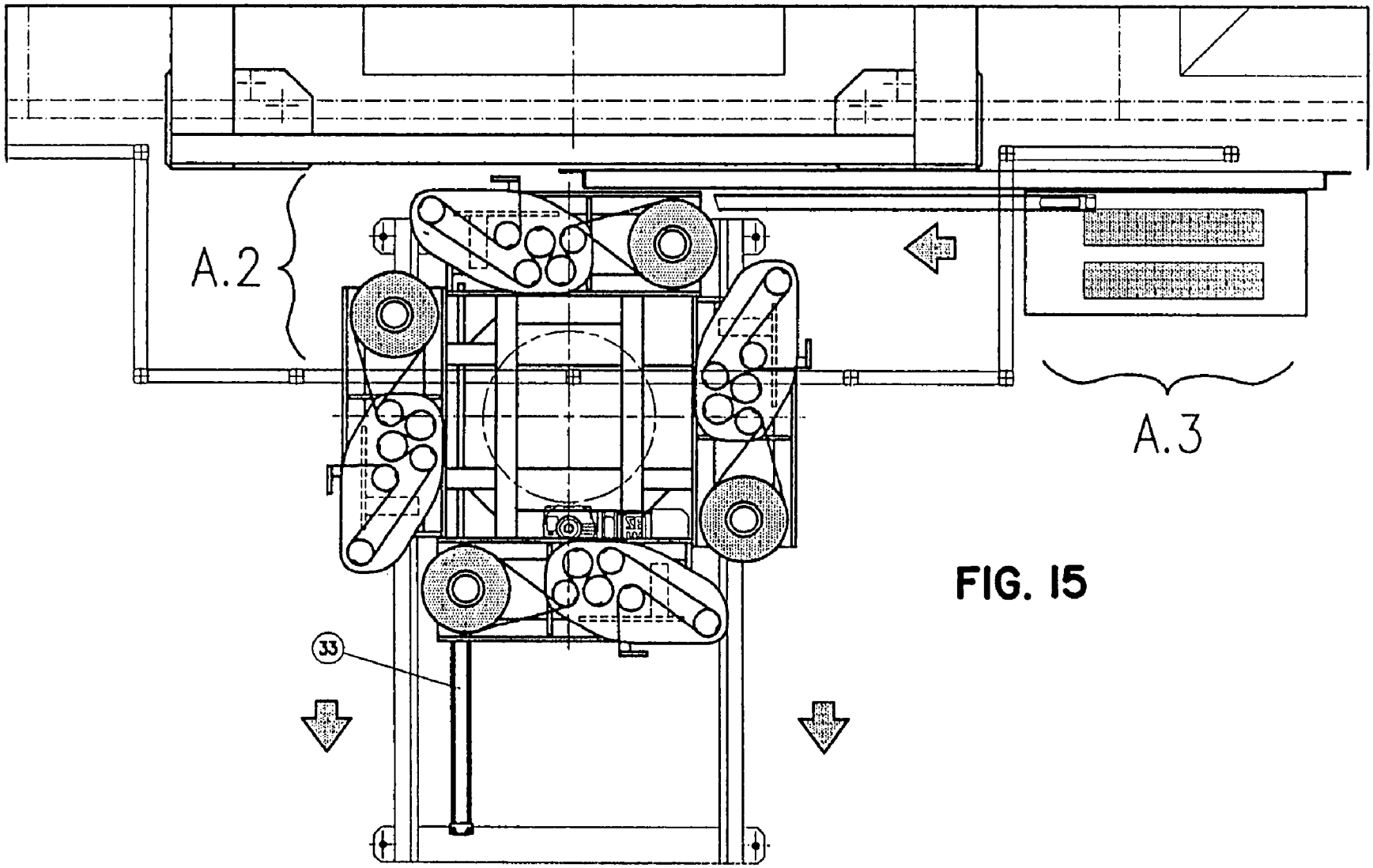
Figure 16:
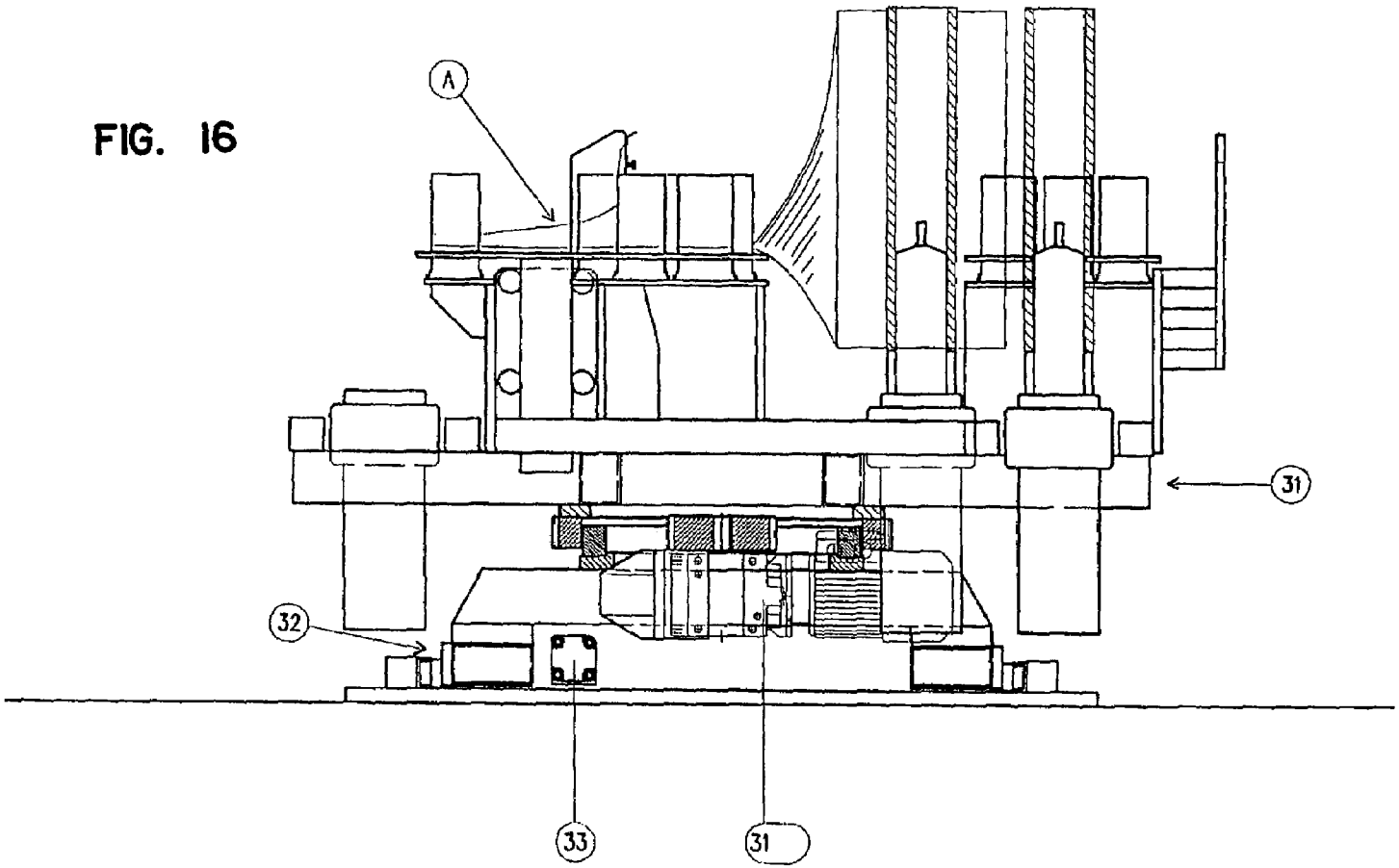
FIG. 16 is the front view of the detail of the apparatus of FIGS. 14 and 15.

The movement of the service carriage to bring it into the position of expulsion A.1 and into the position of picking up A.2 is obtained with two systems:

Linear system E: suitable for one or two service carriages A (FIG. 13);

Carousel system F: suitable for three or more service carriages A (FIGS. 14, 15 and 16).

The linear system E (FIG. 13) consists of a conveyor with two linear guides 22, on which the service carriage A slides, being actuated, for example, by two combined pneumatic cylinders 23 and 24 (FIGS. 1, 5, 6, 7 and 8), or some other system, of which one, 23, fixed to the carriage, brings the service carriage A into the position of expulsion of the reel that has run out or is defective A.1, whilst the other, 24, fixed to the conveyor, sets the carriage A in the position for picking up the new reel A.2.

On the linear conveyor 22 there can slide two carriages, which park at the two ends thereof and alternately set themselves in a position of expulsion A.1 and a position of picking up A.2.

The carousel system F (FIGS. 14, 15 and 16) consists of a turntable 31, which can rotate through 360°, on which there are fixed three or more service carriages A. Rotation through 360° is obtained, for example, with a self-plugging motor reducer 31*bis* or some other system.

The turntable 31 is mounted on the carriage 32, which can slide on linear guides, being actuated, for example, by a pneumatic cylinder 33 or other system.

The reel that has run out or is defective 5 is expelled into a sliding box 34, actuated, for example, by a pneumatic cylinder 35 or other system, which, after gathering the reel that has run out 5, returns into the parking position A.3 (FIG. 15).

The carriage 32 performs the translation forwards, bringing the service carriage A, fixed on the turntable 31, into the position for picking up a new reel A.2 (FIG. 15).

After the reel-carrier assembly B has positioned itself at the height of start of rotation B.1 (FIG. 11), the carriage 32 performs the translation backwards, bringing the service carriage A back into the parking position A.0.

The wrapping cycle resumes and is completed, as described above.

The turntable 31 performs a fraction of rotation, the angle of which varies according to the number of service carriages A fixed on the turntable 31 (120° for 3 carriages-90° for 4 carriages-72° for 5 carriages-60° for 6 carriages).

Once rotation is completed, the subsequent carriage A is in the parking position A.0, ready for the next reel change, while the operator sees to restarting the carriage that has already performed the reel change.

The invention claimed is:

1. An apparatus for automatic change of the reel of extensible film in wrapping machines for packaging palletized loads, with the pallet stationary or the pallet rotating, said apparatus comprising:

a fixed or rotating supporting structure for wrapping the film around a pallet, provided with an assembly for carrying a reel of the wrapping film and with means for retention of the free end of the film of a reel; the fixed or rotating structure, constrained to the sliding frame, being mobile vertically for moving said assembly between a raised wrapping position and a lowered position for changing reel that has run out or is defective;

a service carriage for carrying a new reel, provided with means of temporary support of the free end of the film of the new reel, which is configured to co-operate with said retention means; the carriage being mobile between two end positions respectively of parking and of changing the reel that has run out or is defective;

means of release and of expulsion of the reel that has run out or is defective from the fixed or rotating supporting structure;

means for positioning the carriage for carrying a new reel into a position corresponding to the assembly that carries the reel that has run out or is defective;

means for causing the assembly of the wrapping reel to perform said vertical translation up to said position of reel change, in which it is in a position corresponding to the carriage for carrying a new reel in order to cause the respective spindles for carrying a reel to co-operate with the respective means for temporary support and retention of the end of the film;

means for picking up the new reel from the carriage on which it is located and for constraint with the assembly carried by the wrapping ring;

means for transfer of the free end of the film of the new reel from said means of temporary support to said retention means;

means for bringing back the fixed or rotating supporting structure into the wrapping position; and means for moving the carriage away to bring a new reel from the position of reel change;

wherein the carriage for carrying a new reel slides on a conveyor equipped with two linear guides, actuated by pneumatic cylinders, and wherein the pneumatic cylinders are two combined cylinders, of which one cylinder, which is fixed to the carriage, carries the carriage into a position of expulsion of the reel that has run out or is defective, and wherein the other cylinder, which is fixed to the conveyor, sets the carriage in a position for picking up the new reel.

2. The apparatus according to claim 1, wherein the carriage for carrying a new reel is moved between the position of parking and that of reel change by a pneumatic cylinder.

3. The apparatus according to claim 1, wherein two carriages slide on the linear conveyor, which park at the two ends thereof, and alternately set themselves in a position of expulsion and a position of picking up.

4. An apparatus for automatic change of the reel of extensible film in wrapping machines for packaging palletized loads, with the pallet stationary or the pallet rotating, said apparatus comprising:

a fixed or rotating supporting structure for wrapping the film around a pallet, provided with an assembly for carrying a reel of the wrapping film and with means for retention of the free end of the film of a reel; the fixed or rotating structure, constrained to the sliding frame, being mobile vertically for moving said assembly between a raised wrapping position and a lowered position for changing a reel that has run out or is defective;

a service carriage for carrying a new reel, provided with means of temporary support of the free end of the film of the new reel, which is configured to co-operate with said retention means; the carriage being mobile between two end positions respectively of parking and of changing the reel that has run out or is defective;

means of release and of expulsion of the reel that has run out or is defective from the fixed or rotating supporting structure;

means for positioning the carriage for carrying a new reel into a position corresponding to the assembly that carries the reel that has run out or is defective;

means for causing the assembly of the wrapping reel to perform said vertical translation up to said position of reel change, in which it is in a position corresponding to the carriage for carrying a new reel in order to cause the respective spindles for carrying a reel to co-operate with the respective means for temporary support and retention of the end of the film;

means for picking up the new reel from the carriage on which it is located and for constraint with the assembly carried by the wrapping ring;

means for transfer of the free end of the film of the new reel from said means of temporary support to said retention means;

means for bringing back the fixed or rotating supporting structure into the wrapping position; and means for moving the carriage away to bring a new reel from the position of reel change;

wherein the carriage for carrying a new reel is slidable on linear guides, on which there are fixed:

a) a spindle for housing the new reel; and b) said means of temporary support comprising:

b1) a set of vertical sleeves;

b2) a spring clamp for fixing the trailing end of the film; and b3) a slidable film-pusher plate.

5. The apparatus according to claim 4, wherein the carriage for carrying a new reel comprises a fixed spindle for unloading the reel that has run out or is defective.

6. The apparatus according to claim 5, wherein release and expulsion of the reel that has run out or is defective occurs by inserting the reel that has run out or is defective in said spindle when the reel that has run out or is defective is in vertical alignment with the spindle for picking up the new reel; the release of the reel that has run out or is defective occurring via closing of jaws with supporting lugs of an engagement assembly, actuated by a puller/pusher by a lever, positioned through a cam, witch is in turn controlled by a pneumatic means fixed to a sliding frame for supporting the fixed or rotating supporting structure.

7. The apparatus according to claim 6, further comprising pushers, hinged on levers actuated by collars fixed on the puller; the latter being held in position by a ring anchored to the puller, which is blocked by the rollers which are fixed to an anchoring hub of the pick-up spindle.

8. The apparatus according to claim 6, wherein the means of temporary support, which comprises a roller assembly, are insertable in the retention means, which comprise an assembly of grooved sleeves, and the pick-up spindle is configured to fit into the core of the new reel, pushing the spindle fixed on the carriage downwards.

9. The apparatus according to claim 8, wherein the pick-up spindle is provided with an anti-wrapping brake with adjustable torque, and with a top centering cone having compensation springs to adapt to possible minor variations in length of the core of the new reel.

10. An apparatus for automatic change of the reel of extensible film in wrapping machines for packing palletized loads, with the pallet stationary or the pallet rotating, said apparatus comprising:

a fixed or rotating supporting structure for wrapping the film around a pallet, provided with an assembly for carrying a reel of the wrapping film and with means for retention of the free end of the film of a reel; the fixed or rotating structure, constrained to the sliding frame, being mobile vertically for moving said assembly between a raised wrapping position and a lowered position for changing a reel that has run out or is defective;

an assembly including a service carriage for carrying a new reel, provided with means of temporary support of the free end of the film of the new reel, which is configured to co-operate with said retention means; the carriage being mobile between two end positions respectively of parking and of changing the reel that has run out or is defective; and wherein the assembly for carrying a new reel comprises a carousel system obtained with a turntable that can rotate through 360°, on which there are fixed three or more carriages; the rotation through 360° being obtained with a self-plugging motor reducer, wherein the turntable is mounted on a carriage, which can slide on linear guides and is actuated by a pneumatic cylinder;

means of release and of expulsion of the reel that has run out or is defective from the fixed or rotating supporting structure;

means for positioning the carriage for carrying a new reel into a position corresponding to the assembly that carries the reel that has run out or is defective;

means for causing the assembly of the wrapping reel to perform said vertical translation up to said position of reel change, in which it is in a position corresponding to the carriage for carrying a new reel in order to cause the respective spindles for carrying a reel to co-operate with the respective means for temporary support and retention of the end of the film;

means for picking up the new reel from the carriage on which it is located and for constraint with the assembly carried by the wrapping ring;

means for transfer of the free end of the film of the new reel from said means of temporary support to said retention means;

means for bringing back the fixed or rotating supporting structure into the wrapping position; and means for moving the carriage away to bring a new reel from the position of reel change;

wherein the carriage can be translated forwards to bring the carriage, fixed on the turntable, into the position of picking up the new reel and can be translated backwards, bringing the carriage back into the parking position after the wrapping reel-carrier assembly is positioned at the height of start of rotation.

11. The apparatus according to claim 10, wherein the turntable performs a fraction of rotation, the angle of which varies according to the number of the carriages fixed on the turntable.

* * * * *